United States Patent [19]

Gerhardt

[11] 4,118,024

[45] Oct. 3, 1978

[54] APPARATUS FOR HANDLING FACING SHEETS FOR THE PRODUCTION OF PRESSED BOARD AND OTHER LAMINATES

[75] Inventor: Klaus Gerhardt, Rheurdt, Germany

[73] Assignee: G. Siempelkamp GmbH & Co., Krefeld, Germany

[21] Appl. No.: 808,373

[22] Filed: Jun. 20, 1977

[30] Foreign Application Priority Data

Jun. 22, 1976 [DE] Fed. Rep. of Germany ..... 2627810

[51] Int. Cl.[2] ..... B65H 29/24; B65H 29/54

[52] U.S. Cl. ..... 271/5; 101/230; 156/563; 156/572; 271/65; 271/276; 271/DIG. 2

[58] Field of Search ..... 271/65, 186, 196, 276, 271/174, DIG. 2, 275, 277, 80, DIG. 9, 3, 4, 5; 156/563, 569, 570, 571, 572; 198/374, 399, 404

[56] References Cited

U.S. PATENT DOCUMENTS

| | | | |
|---|---|---|---|
| 1,595,478 | 8/1926 | Minton | 271/DIG. 2 |
| 1,715,993 | 6/1929 | Cummings | 271/5 |
| 4,007,669 | 2/1977 | Achelpohl | 271/DIG. 9 |

*Primary Examiner*—Bruce H. Stoner, Jr.
*Attorney, Agent, or Firm*—Karl F. Ross

[57] ABSTRACT

An apparatus for handling facing sheets for application to pressed board and other laminate stacks adapted to be bonded together comprises a feed device for causing engagement of the uppermost sheet of a pile of facing sheets with a pick-up device of a drum which destacks the sheets individually and advances them to an assembling table at which the laminate stack is formed. The drum is associated with a reversible drive for enabling the trailing end of the sheet to pass a discharge point, whereupon reversal of the direction of rotation of the drum feeds the sheet with its trailing end foremost to the laminate stack thereby enabling the facing sheets to be applied alternately with their top faces turned upwardly or downwardly.

10 Claims, 9 Drawing Figures

APPARATUS FOR HANDLING FACING SHEETS FOR THE PRODUCTION OF PRESSED BOARD AND OTHER LAMINATES

FIELD OF THE INVENTION

The present invention relates to a device for the manipulation of facing sheets adapted to be applied to a laminate stack which can be bonded together into a unitary structure and, more particularly, to a device which enables the facing sheet to be applied to the underside or topside of such stack.

BACKGROUND OF THE INVENTION

In the preparation of pressed board, i.e. a relatively rigid structure which can be pressed from various materials and bonded with the aid of natural or synthetic resins, it is not uncommon to apply flexible facing sheets to the upper surface or the lower surface of a core formed by the pressed board, thereby constituting a laminate. Facing sheets of various types may be employed. For example, the facing sheet may be a contoured and patterned layer which is applied to impart a desired pattern to the pressed board in the formation of so-called paneling or decorative pressed board. The facing sheet may also, if desired, be a sealing layer or a protective layer whose function it is to protect against wear and underlying layer, e.g. a patterned sheet of the type described. In all of these cases it is necessary, in forming a laminate of pressed board to apply a facing sheet to the press board or, more generally, to a stack.

The term "pressed board" is used herein to refer generally to all parts of fiber and particle boards, whether the latter are porous or impermeable to fluids or whether the bonding resins are naturally occuring materials present in the particles to be bonded together, or are synthetic resins which may be firmly activated to effect the bonding under heat and pressure.

In practically all cases, the laminate is subjected to pressure, e.g. in a platen press, and usually also to heating to activate the synthetic resin binder.

Typical material which can be used in particle and fiber boards for the aforedescribed purpose, are wood chips, saw dust, other wood particles, cellulosic and wood fibers, mixtures of cellulosic fibers and other fibers and the like. In addition, the laminate may include a pressed board of the aforedescribed type sandwiched between or having on one side thereof a layer of wood in the form of veneer. In this case, the particles or fiber board may be a core flanked between a pair of such veneers in the manner of plywood.

The binder which is customarily used can be the natural abietic resins of the wood particles or fibers or synthetic resins preferably of the thermally hardenable type such as melamine, phenolformaldehyde, resorcinol and urea resins.

With the process of the present invention any pressed board, particle board, fiber board or composite or sandwich board of the aforedescribed type may be used.

It has been proposed heretofore, in the manipulation of sheets, to provide a device for the handling of sheets which includes a device for removing a single sheet from a stack of such sheets, a manipulating drum having a fixing device for entraining the leading edge of a sheet fed from the aforementioned stack and carrying the sheet to a location remote from this stack, and a table or surface for assembling the laminate stack at the latter location, the sheet carried by the drum being generally fed with its leading edge foremost on the assembling table or surface. The fixing device on the drum can be a clamp or a suction head which can release the leading edge of the sheet as the latter approaches the assembly table, the advance of the sheet after release of the leading edge being effected by frictional engagement of the periphery of the drum with the sheet.

A pressing unit, e.g. a plurality of pressure rollers angularly spaced about the periphery of the drum, can be provided for holding the sheet against the drum periphery while the latter advances the sheet onto the assembly table after the fixing device has been released. Between the table and the drum, moreover, means can be provided for deflecting the sheet onto the table away from the periphery of the drum.

A device for manipulating sheets in the manner described has not been found to be effective for the application of facing sheets to pressed board in all instances and these devices are, therefore, more generally used for the handling of paper sheets, synthetic foil sheets or the like in connection with printing plants or plants for the fabrication of bags or sacks.

One of the problems encountered in attempting to use such a device for the handling of facing sheets in connection with the fabrication of faced particle board, fiber board or the like resides in the fact that the sheets can only be applied in one sense to the stack, i.e. to the upper face of the sheet as it is removed from the stack being applied to the assembly cable with its upper face in the same orientation. Thus when it is desired to apply a facing sheet at the bottom of the stack with its upper face turned downwardly and a sheet at the top of the stack with its upper face turned upwardly, the device or apparatus described is not satisfactory.

Typical facing sheets or overlays for pressed board are asymmetrical, i.e. have a synthetic-resin impregnated surface which must be turned toward the pressed board so that, upon the application of heat and pressures to the laminate, the synthetic resin impregnated side bonds to the remainder of the stack or laminate. This underscores the importance of being able to apply these sheets with alternating orientation to the assembly table since, if upper and lower facing sheets are to be applied, they must be oriented oppositely so that at all times the synthetic resin impregnated side of the facing sheet contacts the core of the pressed board.

ABSTRACTS OF THE INVENTION

It is the principal object of the present invention to provide an apparatus for the handling of sheets, especially facing sheets for pressed board laminates, which enables the application, if desired, of such sheets with alternately reversed orientation to the upper and lower surfaces of the stack.

Still another object of the invention is to provide an apparatus particularly adapted for use in the fabrication of faced chip board, particle board and fiber board or the like which selectively enables the application of the successive sheets to the laminate with the same orientation or with alternately reversed orientation.

SUMMARY OF THE INVENTION

These objects and others which will become apparent hereinafter are retained, in accordance with the present invention, in a system of the aforedescribed type in which the drum is flanked by two pressure assemblies, one of which is effective while the sheet is advanced with its leading edge forwardly in the direction of advance while the other becomes effective when, upon reversal of rotation direction of the drum, the sheet is displaced with its trailing edge foremost onto the assembly surface previously described. Between the pressure units, there is provided a deflecting element which is selectively operable to feed the sheet from the forward pressure unit onto the assembly table or to feed the sheet from the reverse pressure unit onto the assembly table.

According to the invention, when the sheet is to be deposited upon the assembly table with the upper surface (at the sheet stack) being upwardly facing in the laminate stack, the sheet is engaged at its leading edge by the fixing device and is held against the periphery of the drum while the latter rotates in one sense to carry the sheet toward the assembly table. The fixing device is then released and the deflecting element comes into play to direct the leading edge of the sheet onto the table, whereupon the pressure between trailing portions of the sheet by the forward pressure unit, causes the periphery of the drum to advance the sheet to the collecting table.

If the sheet is required at the collecting table in the opposite orientation, i.e. with its upper surface (in the sheet stack) turned downwardly, the deflecting element is not operated as the leading edge approaches and the leading edge is entrained past the deflecting element toward the pick-up point until the trailing edge is disposed in the region of the deflector; drum rotation is then reversed and the sheet is fed with its trailing edge foremost onto the collecting table, thereby depositing the sheet thereon with the upper face turned downwardly. The sheet can be deposited directly upon the collecting surface, whereupon the balance of the pressed board can be applied to the sheet, and a further facing sheet can then be applied with its upper surface turned upwardly.

According to a feature of the invention, the deflecting element can be symmetrical about a plane which can correspond to the level of the collecting table. Furthermore, the deflecting element is generally disposed at the level of the collecting assembly table which can be vertically displaceable, i.e. lowerable so that, after the first facing sheet has been applied and the remainder of the pressed board deposited thereon, the table is lowered so that the upper facing sheet is applied at the level of the deflector.

While each of the rollers of the forward pressure roller unit and/or the reverse pressure roller unit can be driven synchronously with the drum, i.e. with the same peripheral speed as that of the drum, it is also contemplated within the invention that they merely be entrained by friction.

The pressure units of the present invention can have various configurations although it is preferred that both the forward and reverse pressure units be constituted by rollers angularly spaced along the periphery of the drum, the forward pressure unit being disposed on one side of the drum while the reverse pressure unit is disposed on the opposite side of the drum.

However, it is also possible within the scope of the present invention to provide the pressure units as pressure belts which are held against the periphery of the drum and urge the sheet thereagainst.

The deflecting element can be of relatively simple form. In accordance with a preferred embodiment of the invention, the deflecting element is a deflecting beam having upwardly and downwardly directed trained deflecting nozzles through which jets of air can be ejected for lifting the leading or trailing edges of the sheet away from the periphery of the drum and causing these edges to engage curved surfaces which guide the sheet onto the collectingly assembly table. In addition, the beam may be wedge shaped against the oncoming leading edge and, symmetrically, wedge shaped and converging against the advancing trailing edge upon reversal of rotation of the drum.

Furthermore, the collecting assembly table can be provided with transport rollers or associated with such transport rollers to facilitate the advance of the sheet onto the collecting table.

In practice, for doubly faced pressed board, the manipulating drum is alternately or selectively switched between simple forward transport movement or alternate transport and transport plus reverse movement depending upon how the facing sheet is to be applied to the chipped board, fiber board or the like. The control movements can be effected by any system using modern control technology, e.g. a preprogrammed computer, a cam arrangement with cam follower switches operating pneumatic or electrical mechanisms or by card, tape or like control, all of which are known in the art.

The advantage gained by the present system will be immediately apparent in that it permits manipulation of facing sheets for the fabrication of chipped board, fiber board, particle board or the like such that the facing sheets can be applied with alternate orientations to the balance of the laminate.

BRIEF DESCRIPTION OF THE DRAWING

The above and other objects, features and advantages of the present invention will become more readily apparent from the following description, reference being made to the accompanying diagrammatic drawing in which.

SPECIFIC DESCRIPTION

Figure 1:
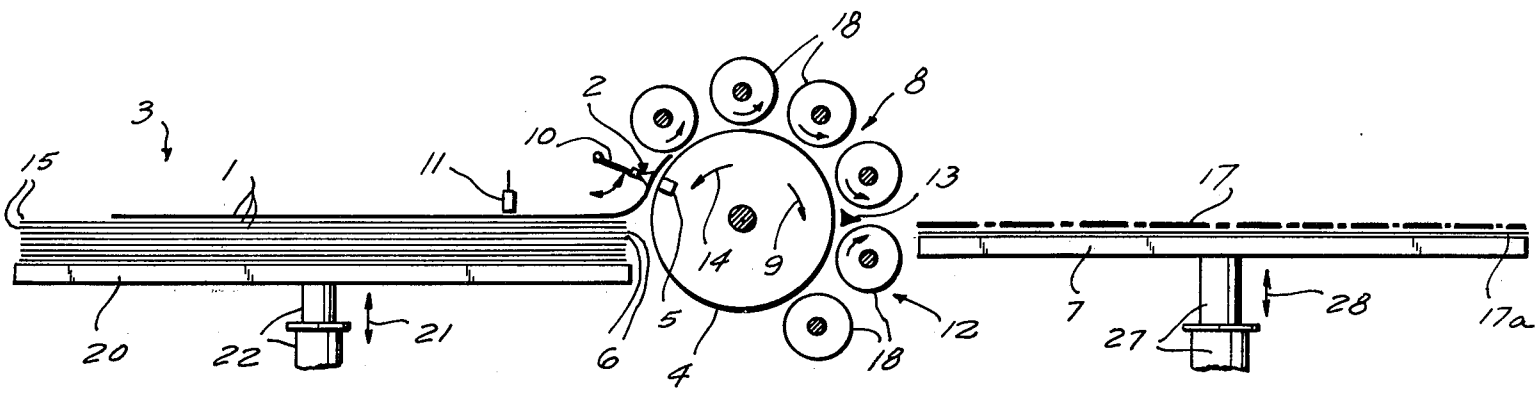
FIG. 1 is a side-elevational view of a device for manipulating facing sheets for application to a laminate stack in the production of particle board, fiber board or the like, showing the system in the position in which a facing sheet has just been picked up by the drum.

The sheet-handling device shown in the drawing comprises an apparatus for delivering the facing sheets 1 to be applied to a pressed board laminate to an assembly table 7 on the underside of the stack or at the upper side thereof, the stack further including at least one particle board mat, fiber-board mat or like precursor for the fabrication of pressed board.

The apparatus basically comprises a device generally represented at 1 for lifting the leading edge of a facing sheet 1 from a pile 3 thereof upon a feed table 20 which can be raised and lowered as represented by the arrow 21 via the telescoping tube arrangement 22.

The feed device 2 is designed to position the leading edge 6 of the sheet in juxtaposition with the pickup 5 of a drum 4 which is rotable about a horizontal axis by a drum drive 23 adapted to displace the drum in the clockwise or the counterclockwise sense selectively to predetermined angular extents. The pickup 5 is here shown to comprise a suction chamber 5*a* covered by a screen 5*b* and connected via a passage 24 to a suction source represented at 25 via a valve 26. The pickup 5 can also represent pickup clamps adapted to engage over the leading edge of the sheet to entrain the latter along the periphery 4*a* of the drum.

Remote from the table 20, there is provided a collecting or assembly table 7 which also is mounted on a telescoping tube support 27 so that it can be raised and lowered as indicated by the arrow 28.

The drum 4 can have an elastic periphery 4*a* composed of rubber so that a forward pressing unit 8 can retain a sheet against the periphery even upon release of the leading edge of the sheet once the sheet passes into the action region of the unit 8. The elastic periphery permits sheets of different thickness or plural layers to be handled.

Figure 2:
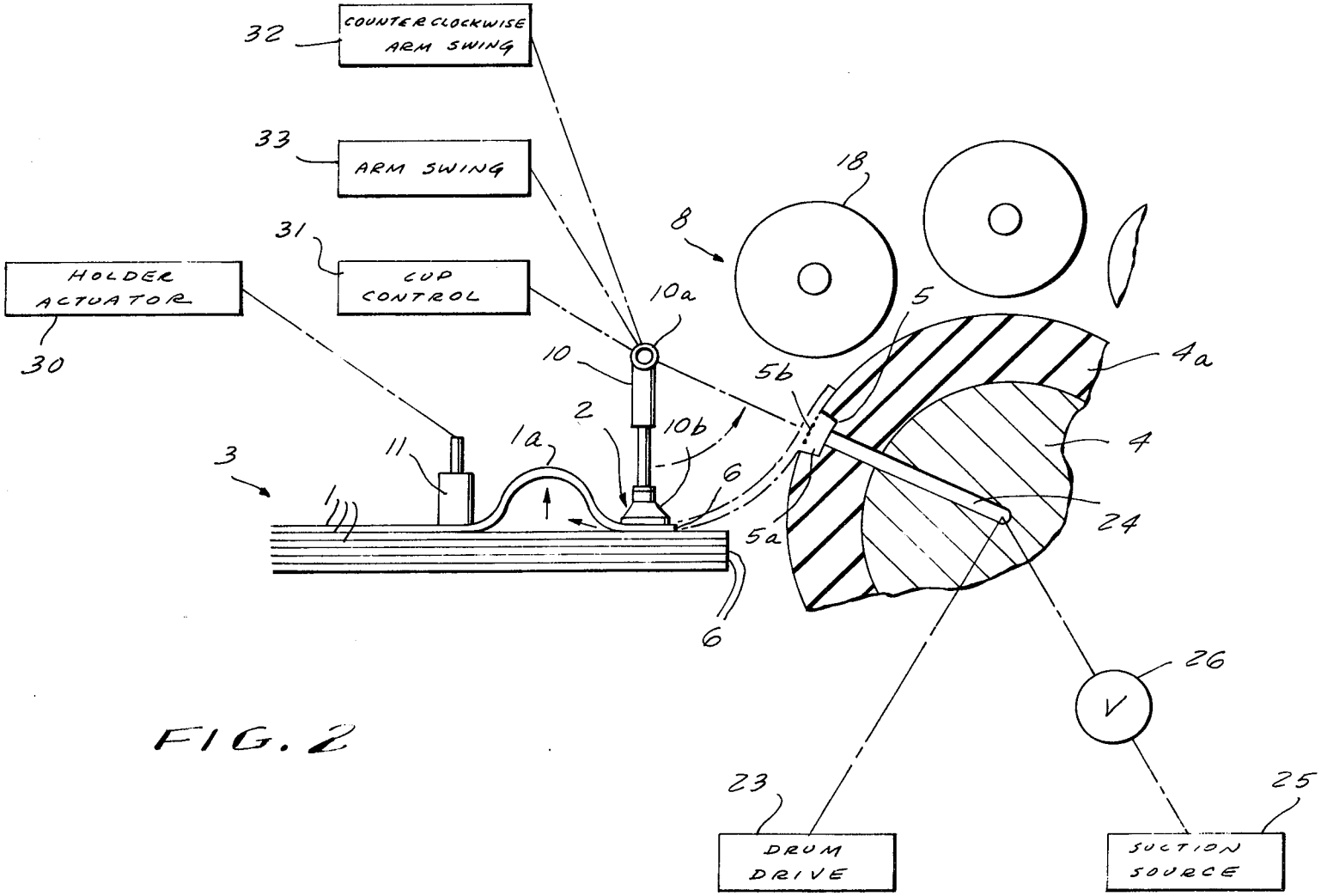
FIG. 2 is a detailed view of a portion of the device of FIG. 1 drawing to an enlarged scale, showing the position of the elements just before the position in FIG. 1.
Figure 3:
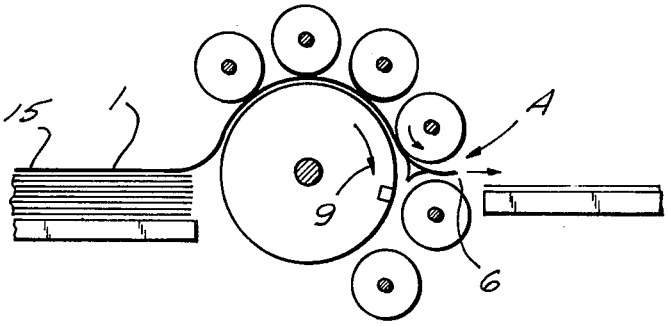
FIG. 3 is a view on the scale of FIG. 1 and corresponding thereto, but illustrating only a portion of the device, showing the position of the elements during the deposition of the facing sheet upon the collecting table.
Figure 5:
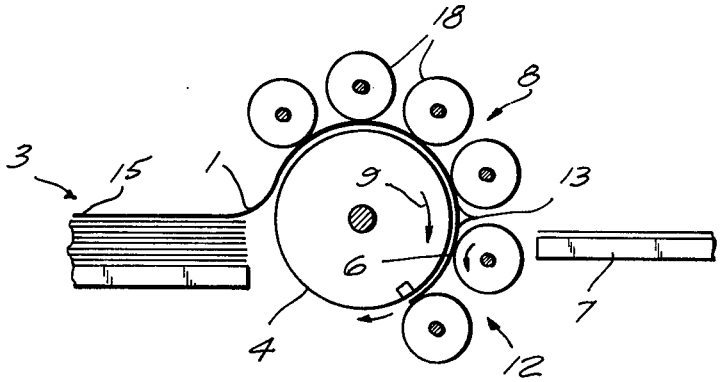
FIG. 5 is a view similar to FIG. 3 showing the position of the system when a reverse movement is to be produced but prior to this reverse movement of the sheet.
Figure 6:
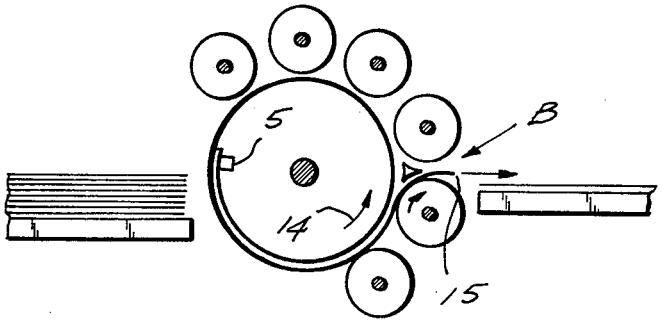
FIG. 6 is a view similar to FIG. 5 showing the inception of the reverse movement.

In the embodiment shown in FIGS. 1 and 2, the unit 8 comprises a plurality of rollers 18 which can be frictionally entrained or can be driven as shown by the arrows, i.e. in the counterclockwise sense when the drum 4 is driven in the clockwise sense represented by the arrow 9. Alternatively the pressure device can be a belt system 8*a* having an endless belt 8*b* passing over rollers 8*c* and 8*d* and adapted to hold a sheet against the periphery of the drum.

Figure 9:
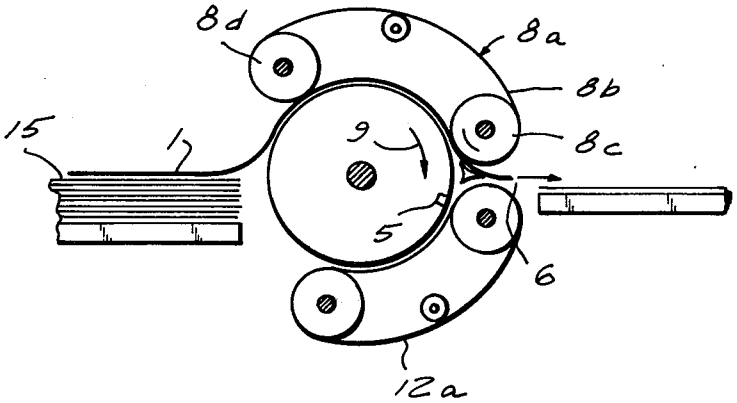
FIG. 9 is a view similar to FIG. 3 but showing the use of a belt as the pressure unit undergoes the forward and reverse operations.

On the opposite side of the plane 17 corresponding to the plane of delivery of the sheet to the laminate or stack 17*a*, there is provided a reverse pressure unit 12 entrained or rotable in the clockwise sense when the drum 4 is rotated in the counterclockwise sense represented by arrow 14. Alternatively, this presure unit can be constituted by the belt arrangement 12*a* shown in FIG. 9.

The feed unit 2 comprises a hold-down member 11 which can be raised or lowered by an actuator, e.g. a solenoid or pneumatic cylinder controlled by a valve or switch as represented at 30.

A suction cup 2 can be raised or lowered in a telescoping arm 10 which is swingable about a pivot 10*a* and connects the suction cup 10*b* with a valve suction source in the usual manner. The advance of the cup 10*b* toward the stack or pile of sheets is effected by the cup control 31 which can be a valve switch controlling the delivery of fluid pressure to the pneumatic cylinder operating the telescoping arms or a solenoid actuating the inner arm.

The swinging movement of the arm 10 is effected by electrical or pneumatic controllers 32 and 33 for movement in the clockwise and counterclockwise sense from the position shown in FIG. 2.

The control elements described previously and subsequently are synchronized by conventional control means, e.g. cam arrangements or an electronic programmer in accordance with the timing diagram given in FIG. 8. Substantially in the plane 17, there is also provided a deflecting element 13, the structure of which will be more readily understandable from FIGS. 4 and 7. Member 13 is of triangular profile and has wedge-shaped portions 19*a* and 19*b* turned into the path of the leading and trailing edges of the sheet, respectively, and extending into arcuate guide surfaces 40 affecting a transition to the plane 17. At the vertices of the wedge portions 19*a* and 19*b*, nozzles 19 are provided and are connected with compressed air sources 34 and 35 via controllable valves.

In operation, the hold-down device 11 ($t_1$ in FIG. 8) lowers to engage the uppermost sheet 1 on the pile 3 and prevent the latter from sliding to the left on the stack. During its clockwise movement, the suction cup 2 has been lowered and is evacuated to engage the upper surface of the sheet 1 and cause the latter to bulge upwardly at 1*a* as is also apparent from FIG. 2. The clockwise movement of arm 10 then commences ($t_2$) and the arm 10 is then swung in the counterclockwise sense to carry the leading edge 6 of the uppermost sheet into juxtaposition with the suction device 5. The latter has been carried by the moving drum into this position and the suction is then turned on $t_3$ to engage the sheet with the drum 4. The drum 4 is then driven in the forward direction (clockwise, arrow 9) with the sheet 1 being pressed against the periphery of the drum by the rollers 18 of the forward pressure unit 8. The leading edge is then released by the pickup 5 as it approaches the deflector 13 and, at $t_4$, the upper feed unit 34 is operated to blow a stream of air 21 between the leading edge 6 of the sheet and the periphery of the drum.

The resilient character of the latter allows the system to be used for sheets of different thickness.

Since the rear portion of the sheet is pressed against the periphery of the drum 4, the sheet is advanced onto the collecting table 7 and any pressed board components previously disposed thereon. It is assumed that the synthetic-resin impregnated side of the sheet 1, is downward. In this manner, the system can operate as is conventional.

Assume, however, that it is desired to provide facing sheets on both faces of the pressed board. In this case, after depositing a sheet on the upper surface of the stack on table 7, the system is actuated to pick up the next sheet ($t_8$) and carry the latter toward the deflector 13. Here, however, the leading edge 6 is not released and is entrained past the deflector 13 whereupon it is held against the periphery of the drum by the reverse pressing unit 12. Once the trailing edge 15 has passed the deflector 13 ($t_{10}$) the suction at pickup 5 can be interrupted at $t_{11}$ and the drum reversed, thereby feeding the sheet along the lower surface of the deflector 13 with a jet 21 being directed between the sheet and the drum periphery (see FIG. 7). The sheet can thereby be deposited upon the table 7. A pressed board mat can than be placed on the sheet and the process repeated to deposit an upper sheet on the stack.

Figure 4:
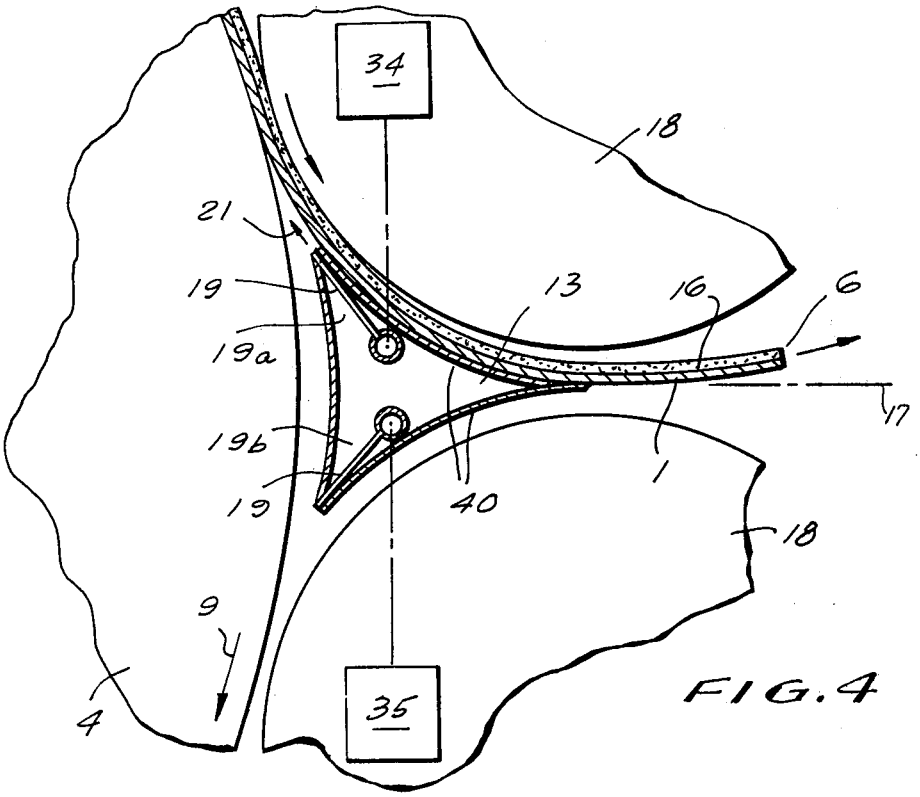
FIG. 4 is a detail view of the region of the deflecting element, drawn to a still larger scale, and corresponding to a view taken in the direction of arrow A of FIG. 3.
Figure 7:
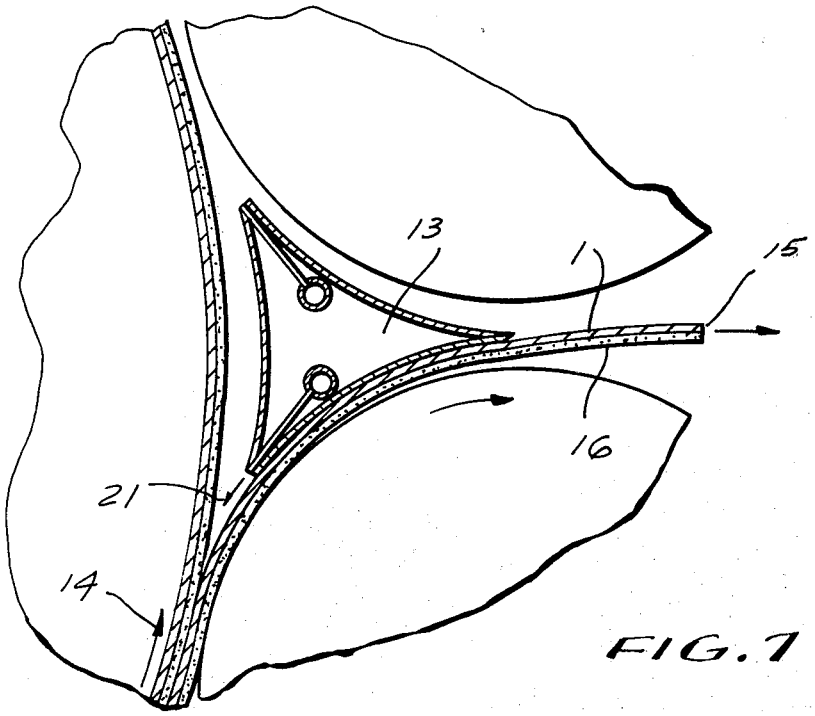
FIG. 7 is a view similar to FIG. 4, but taken in the region B of FIG. 6 and showing the reverse movement, drawn to an enlarged scale.
Figure 8:
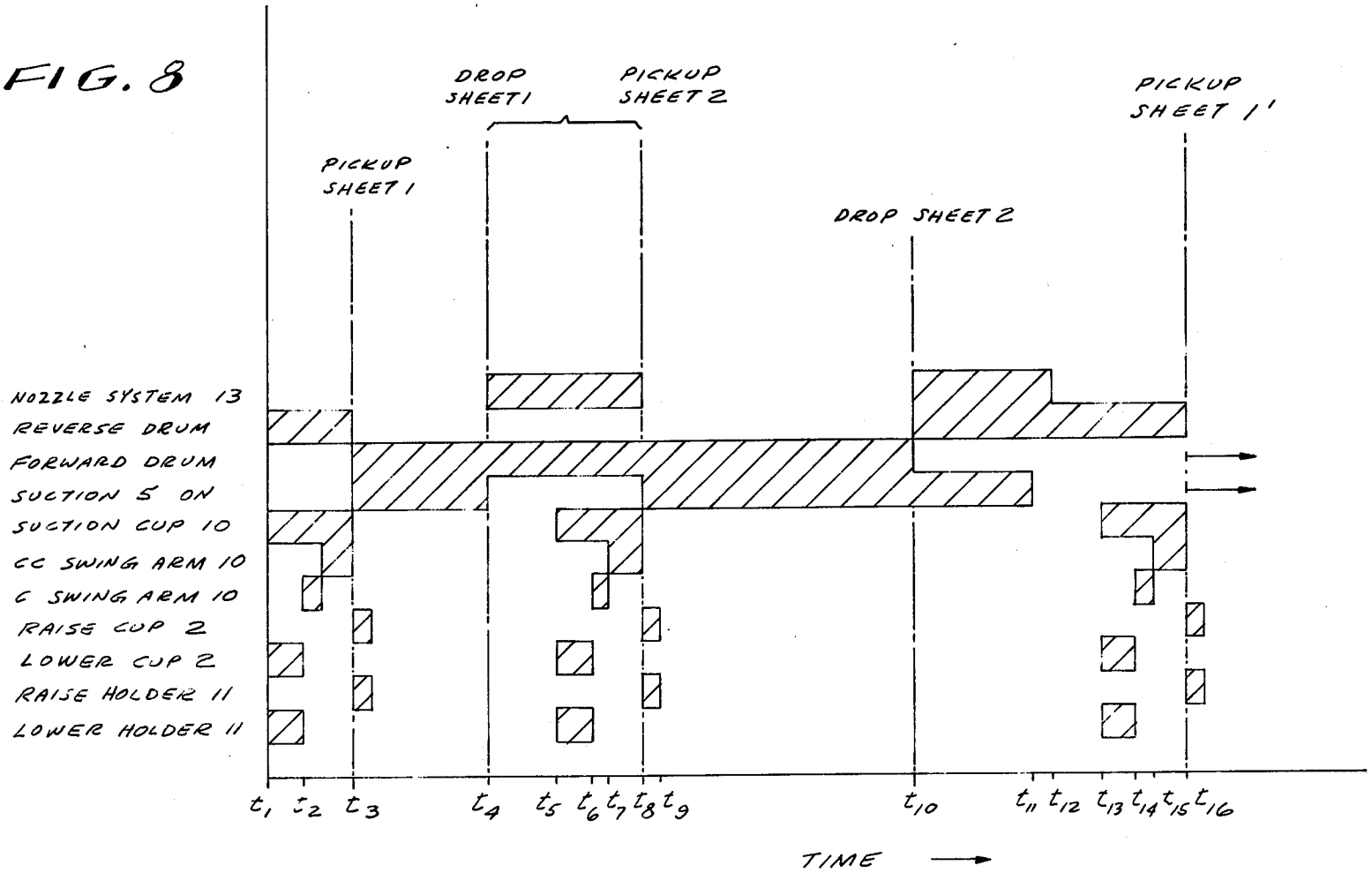
FIG. 8 is a timing diagram illustrating the sequencing of the various devices of the system described in connection with FIG. 1 and 6.

As is apparent from FIGS. 4 and 7, one side of the sheet can have the synthetic-resin coating while the other side of the sheet is of the facing material, the synthetic-resin coating being aplied to the core of the stack in each case so that the laminate can be pressed to a unitary board.

With the operation just described, the alternate sheets as applied to the stack are reversed with the upper surface facing first downwardly and then upwardly.

Naturally, the system just described can be used for the production of synthetic-resin laminates as well as in the production of pressed board.

I claim:

1. A sheet-handling apparatus which comprises:

means for receiving a pile of sheets having a leading edge and a trailing edge;

a drum disposed adjacent said pile and reversibly rotatable about an axis, said drum being formed with a pickup engageable with a portion of a sheet adjacent the leading edge thereof;

a deflector disposed adjacent said drum for guiding a leading edge of a sheet entrained by said drum in one sense of rotation and a trailing edge of a sheet entrained by said drum in an opposite rotational sense away from the periphery of said drum;

an assemby table receiving said sheets from said deflector;

forward pressing means for urging a sheet against the periphery of said drum during displacement of said drum in said one sense; and reverse pressing means for retaining a sheet against the periphery of said drum upon rotation of said drum in said opposite sense, whereby said drum is adapted to dispose said sheets selectively in the same orientation and in reverse orientation upon said table.

2. The apparatus defined in claim 1 wherein at least one of said pressing means comprises a plurailty of rollers spaced about the periphery of said drum for urging said sheet thereagainst.

3. The apparatus defined in claim 1 wherein at least one of said pressing means comprises a pressing belt adapted to urge a sheet against said periphery of said drum.

4. The apparatus defined in claim 1 wherein said deflector comprises a bar having vertices adapted to guide sheets away from said periphery of said drum, and respective nozzles in said vertices trained in opposite directions against the periphery of said drum.

5. The apparatus defined in claim 4 wherein said deflector is formed with guide surfaces for guiding said sheets onto a plane.

6. The apparatus defined in claim 1 wherein said periphery of said drum is adapted to accommodate sheets of different thicknesses or different numbers of layers.

7. The apparatus defined in claim 1 wherein said drum is rotatable about a horizontal axis and said table is horizontal and vertically shiftable to form a sheet-receiving plane extending through the axis of said drum, said deflector being symmetrically shaped about said plane and said forward and reverse pressingmeans being disposed on opposite sides of said plane.

8. The apparatus defined in claim 7 wherein each of said pressing means comprises a plurality of rollers spaced apart peripherally of said drum and said pickup is a suction head.

9. The apparatus defined in claim 8, further comprising feed means adjacent said drum for advancing uppermost sheets of said pile into engagement by said pickup.

10. The apparatus defined in claim 9 wherein said feed means includes an arm engaging an uppermost sheet and swinging the leading edge of same toward said drum.

* * * * *